US008649708B2

(12) United States Patent
Watanabe et al.

(10) Patent No.: US 8,649,708 B2
(45) Date of Patent: Feb. 11, 2014

(54) DEVELOPING APPARATUS AND IMAGE FORMING APPARATUS INCLUDING THE SAME

(75) Inventors: Akihiro Watanabe, Osaka (JP); Norio Kubo, Osaka (JP); Yukihiro Mori, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 105 days.

(21) Appl. No.: 13/343,812

(22) Filed: Jan. 5, 2012

(65) Prior Publication Data

US 2012/0177412 A1 Jul. 12, 2012

(30) Foreign Application Priority Data

Jan. 12, 2011 (JP) ..... 2011-003577
Jan. 12, 2011 (JP) ..... 2011-003579
Aug. 8, 2011 (JP) ..... 2011-173305

(51) Int. Cl.
*G03G 15/08* (2006.01)

(52) U.S. Cl.
USPC ..... 399/256; 399/254

(58) Field of Classification Search
USPC ..... 399/254, 256
See application file for complete search history.

(56) References Cited

U.S. PATENT DOCUMENTS 5,440,376 A 8/1995 Hagihara
6,035,168 A * 3/2000 Masuda et al. ..... 399/254
2008/0181672 A1 * 7/2008 Hatakeyama et al. ..... 399/254

FOREIGN PATENT DOCUMENTS

JP 5-289506 11/1993
JP 11-065248 3/1999
JP 2001-265098 * 9/2001 ..... G03G 15/08
JP 2004-233605 8/2004
JP 2006-018210 1/2006

* cited by examiner

*Primary Examiner* — Clayton E Laballe
*Assistant Examiner* — Jas Sanghera
(74) *Attorney, Agent, or Firm* — Morgan, Lewis & Bockius LLP

(57) ABSTRACT

A developing apparatus according to the present disclosure is partitioned into a plurality of convey chambers which include a first convey chamber and a second convey chamber which are disposed substantially in parallel with each other, the second convey chamber has a U shape in section, a sensor disposition portion, where a toner concentration sensor is disposed on a bottom surface, is formed in an upstream with respect to a restriction portion in a developer convey direction, across a predetermined width in the developer convey direction including a detection surface of the toner concentration sensor, a distance between curved surface portions on both sides of a U-shaped inner wall surface and the second stir member is wider than another portion of the second stir chamber.

10 Claims, 6 Drawing Sheets

DEVELOPING APPARATUS AND IMAGE FORMING APPARATUS INCLUDING THE SAME

INCORPORATION BY REFERENCE

This application is based on Japanese Patent Application No. 2011-3577 filed on Jan. 12, 2011, No. 2011-3579 filed on Jan. 12, 2011 and No. 2011-173305 filed on Aug. 8, 2011, the contents of which are hereby incorporated by reference.

BACKGROUND

The present disclosure relates to a developing apparatus that is used for image forming apparatuses such as a copy machine, a printer, a facsimile, a multi-function machine of them and the like that use an electro-photographic system, and an image forming apparatus that includes the developing apparatus, more particularly, to a developing apparatus that performs supply of a two-component developer including a toner and a carrier, and discharges a surplus developer, and to an image forming apparatus that includes the developing apparatus.

In an image forming apparatus, a latent image formed on an image bearing member that includes a photosensitive drum and the like is developed by a developing apparatus to visualize the latent image as a toner image. As one of such developing apparatuses, a two-component developing system, which uses a two-component developer, is employed. This kind of developing apparatus stores, in a developer container, a developer including toners and carriers, disposes a development roller that supplies the developer to the image bearing member, and disposes a stir member that supplies the developer to the development roller stored in an inside of the developer container while conveying and stirring the developer.

In this developing apparatus, the toners are consumed by a development operation, while the carriers are not consumed and remain in the developing apparatus. Accordingly, the carriers stirred in the developer container together with the toners are deteriorated as the stirring frequency increases, as a result of this, charge performance of the carriers for the toners gradually becomes low.

Because of this, a developing apparatus is proposed, which supplies, into a developer container, a developer including carriers and discharges a surplus developer, thereby curbing deterioration in charge performance.

For example, a structure is known, in which two stir members, which each include a rotational shaft and a spiral blade spirally formed on the rotational shaft, are disposed in parallel with each other in respective convey chambers. A partition portion is disposed between the convey chambers, and at both end portions of the partition portion, communication portions for moving the developer are disposed. And, a developer discharge opening is formed in a downstream in a developer convey direction with respect to one of the convey chamber, and between the stir member and the developer discharge opening, a reverse spiral blade, which is spirally formed in a direction opposite to a direction of the spiral blade of the stir member, is disposed as a restriction portion integrally with the rotational shaft.

According to the above structure, when the developer is supplied into the developer container, thanks to rotation of the stir member, the developer is stirred and conveyed to the downstream side of the convey chamber. When the reverse spiral blade rotates in the same direction as the stir member, a convey force in a direction opposite to the developer convey direction by the stir member is given to the developer by the reverse spiral blade. The developer is blocked in the downstream side of the convey chamber by the convey force in the opposite direction, whereby the developer is increased in height level, so that a surplus developer goes over the reverse spiral blade (restriction portion), moves to the developer discharge opening to be discharged to outside of the developer container.

Besides, in a case where a two-component developer is used, to supply toners by an amount of toners consumed for development, it is necessary to measure a toner concentration in a developer by means of a toner concentration sensor that is disposed in a developer container. For example, a structure is known, in which a toner concentration sensor is disposed on a bottom portion of a housing that stores a two-component developer.

On the other hand, in the above image forming apparatus, a method is known, in which to secure a sufficient fixing performance and improve image quality in a case where especially a recording medium is thick in thickness, a speed (process speed), at which the recording medium on which a toner image is transferred passes through a fixing apparatus, is lowered. Here, if drive sources of the fixing apparatus and the developing apparatus are the same as each other, the developing apparatus also is changed to the low speed drive, so that the convey speed of the developer in the developing apparatus rapidly becomes low and the developer amount in the developing apparatus dramatically changes.

As a result of this, immediately after the process speed is changed, the developer amount in the developing apparatus is not an amount suitable for the process speed, accordingly, an excessive stress acts on the developer and a phenomenon occurs in which the toner concentration in the developing apparatus does not rise, whereby an image concentration becomes low. Besides, if the developer amount dramatically reduces, a corrugation occurs on a developer surface along an outer shape of the stir member in the developing apparatus, whereby there is a disadvantage that if an image is output in the state, an image unevenness occurs. Especially, in a fast speed machine, if the process speed is decelerated at a constant rate, a speed difference becomes large between the usual time and the deceleration time, so that the above disadvantage remarkably occurs.

As a developing apparatus that employs a method for stabilizing a discharge amount of a surplus developer from the developing apparatus, a developing apparatus is known, in which a shutter member is disposed at a developer discharge opening, during only a drive time of the developing apparatus or only a developer supply time, the developer discharge opening is opened. Besides, an image forming apparatus is known, which predicts a change of the developer storage amount in the developing apparatus due to a change of environmental conditions, and in accordance with the prediction result, controls a rotational speed of a stir member.

In the structure in which the two stir members, which each include the rotational shaft and the spiral blade spirally formed on the outer circumference of the rotational shaft, are disposed in parallel with each other in the respective convey chambers, even during a time an additional developer is not supplied, the developer conveyed by the spiral blade of the stir member moves to the downstream side of the convey chamber like a wave along an outer circumference of the spiral blade and collides with the restriction portion. When the developer collides with the restriction portion, the developer height level differs with respect to an outer circumference of the restriction portion in accordance with an axis-directional position of the spiral blade with respect to the restriction portion.

If the developer collides with the restriction portion at a high position of the developer height level (developer surface), thanks to power of the collision, the developer goes over the restriction portion to move to the developer discharge opening, so that there is a risk that the developer is excessively discharged and the developer amount in the developer container does not stabilize. Besides, there also is a risk that spattering of the developer occurs before the restriction portion. Especially, in an image forming apparatus which forms an image at a high speed, the stir member rotates at a high speed together with a photosensitive drum, so that a disadvantage remarkably occurs, in which the developer is excessively discharged and the spattering occurs. To prevent such disadvantages, it becomes necessary to slow down the speed of the developer sent to the restriction portion and to make the change of the developer surface moderate.

On the other hand, to accurately detect a toner concentration by means of a toner concentration sensor, it is necessary to make the developer sufficiently present in an entire detection area of the toner concentration sensor. Because of this, in a case where the toner concentration sensor is disposed on a bottom surface of a developer container, it is necessary to make the developer stay at a sensor disposition position.

Accordingly, to curb the change of the developer surface and increase the detection accuracy of the toner concentration sensor, it becomes necessary to make the developer stay at two positions, that is, the sensor disposition position and a position close to the restriction portion in an upstream with respect to the restriction portion. However, if the developer is made to stay at two positions in a circulation route of the developer, it becomes hard to maintain a circulation balance of the developer. Especially, in the developing apparatus which improves the image quality by changing the process speed between an image forming time and a fixing time and conveying a recording medium at a low speed during the fixing time, when the process speed is changed and the rotational speed of the stir and convey member also is changed, the circulation balance of the developer is lost, and in the case where there are two staying positions for the developer, correction becomes hard.

Besides, according to the method in which the shutter member is disposed at the developer discharge opening, and the developer discharge opening is opened during only a drive time of the developing apparatus or only a developer supply time, it is necessary to dispose the shutter member and its drive mechanism, and open-close control of the shutter member also becomes necessary. Besides, according to the method which predicts a change of the developer stored amount in the developing apparatus due to a change of environmental conditions, and in accordance with the prediction result, controls the rotational speed of the stir member, the rotational speed of the stir member is controlled in accordance with the environmental conditions, so that it is necessary to independently drive the stir member. Accordingly, structures of both the apparatuses become complicated, which leads to cost increase.

SUMMARY

In light of the above problems, it is an object of the present disclosure to provide a developing apparatus that is able to curb occurrence of an defective image and increase a detection accuracy of a toner concentration sensor by stably discharging a surplus developer from a developer container and accurately maintaining a developer amount in the developer container at a predetermined amount even if a process speed changes, and an image forming apparatus that includes the developing apparatus.

To achieve the above object, a developing apparatus according to an aspect of the present disclosure includes a developer container that is partitioned into a plurality of convey chambers which include a first convey chamber and a second convey chamber which are disposed in parallel with each other, and that stores a two-component developer that includes a carrier and a toner, a first stir member that stirs and conveys the developer in the first convey chamber in a rotational axis direction, a second stir member that is composed of a rotational shaft and a spiral blade formed on an outer circumference of the rotational shaft, stirs and conveys the developer in the second convey chamber in a direction opposite to the first stir member, a developer carry body that is rotatably supported in the developer container and carries on a surface thereof the developer in the second convey chamber, a connection portion that connects the first convey chamber and the second convey chamber to each other at both end portions in a longitudinal direction thereof, a developer supply opening that is arranged to supply the developer into the developer container, a developer discharge opening which is disposed at an end portion in a downstream side of the second convey chamber and from which a surplus developer is discharged, wherein the second stir member is provided with a restriction portion that is disposed in a downstream of the connection portion with respect to the second stir member to face the developer discharge opening in a developer convey direction, and places a restriction on movement of the developer to the developer discharge opening, the second convey chamber has a U shape in section, a sensor disposition portion, where a toner concentration sensor is disposed on a bottom surface, is formed in an upstream with respect to the restriction portion in the developer convey direction, across a predetermined width in the developer convey direction including a detection surface of the toner concentration sensor, a distance between curved surface portions on both sides of a U-shaped inner wall surface and the second stir member is wider than another portion of the second stir chamber.

Still other objects of the present disclosure and specific advantages obtained by the present disclosure will become more apparent from the following detailed description of preferred embodiments.

DETAILED DESCRIPTION

Figure 1:
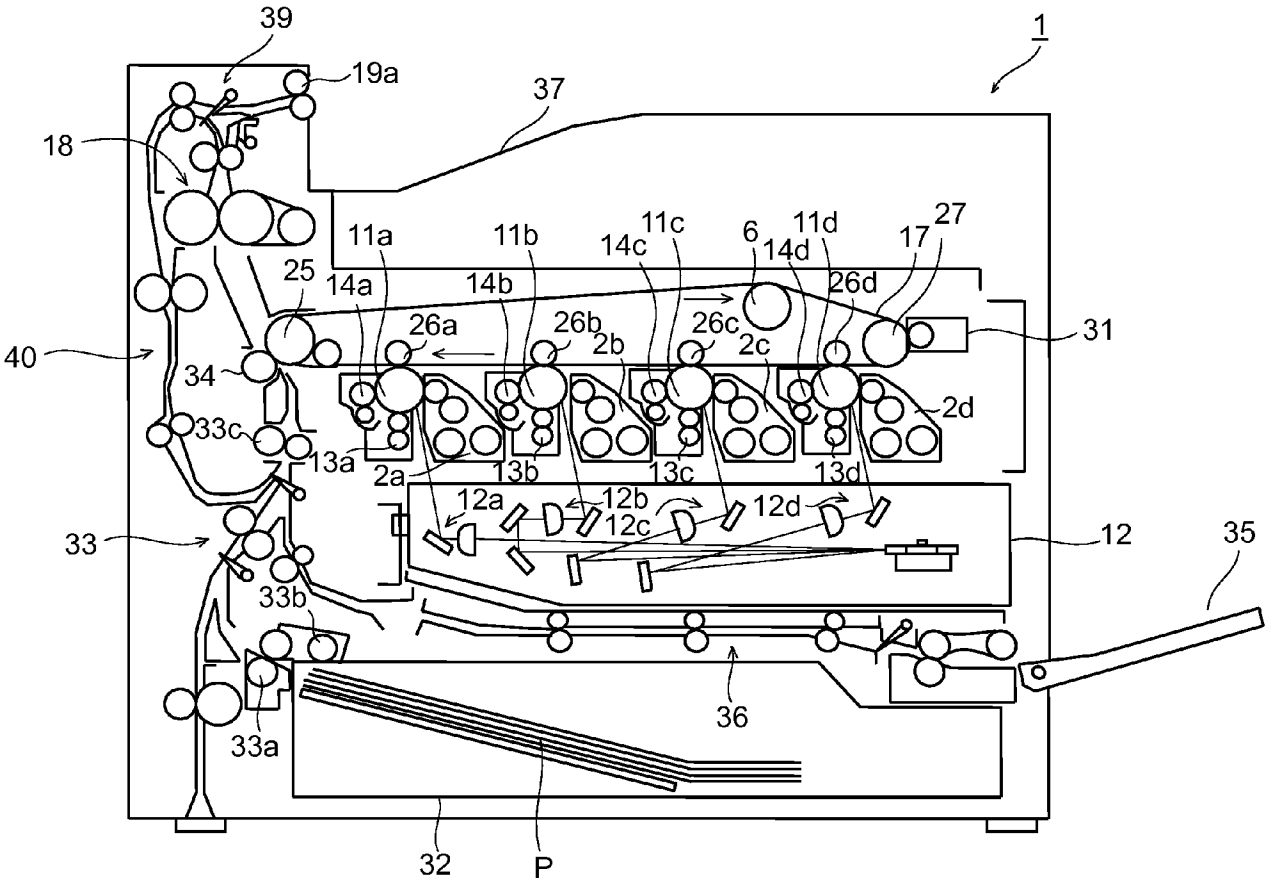
FIG. 1 is a schematic view showing an overall structure of an image forming apparatus 1 in which developing apparatuses 2*a* to 2*d* according to an embodiment of the present disclosure are incorporated.

Hereinafter, embodiments of the present disclosure are described with reference to the drawings. FIG. 1 is a sectional view showing schematically a structure of an image forming apparatus in which a developing apparatus according to the present disclosure is incorporated. An image forming apparatus 1 is a tandem type of color printer in which as rotatable photosensitive drums 11*a* to 11*d*, for example, organic photosensitive drums (OPC photosensitive drums) on which an organic photosensitive layer is formed are used, or amorphous silicon photosensitive drums on which an amorphous silicon photosensitive layer is formed are used. The photosensitive drums 11*a* to 11*d* are disposed corresponding to the respective colors of black, yellow, cyan and magenta. Around the respective photosensitive drums 11*a* to 11*d*, developing apparatuses 2*a* to 2*d*, an exposure unit 12, chargers 13*a* to 13*d* and cleaning apparatuses 14*a* to 14*d* are disposed.

The developing apparatuses 2*a* to 2*d* are disposed to oppose the right side of the photosensitive drums 11*a* to 11*d*, respectively, and supply toners to the photosensitive drums 11*a* to 11*d*. The chargers 13*a* to 13*d* are disposed to face surfaces of the photosensitive drums 11*a* to 11*d* in upstream sides in rotation directions of the photosensitive drums with respect to the developing apparatuses 2*a* to 2*d*, and evenly charge the surfaces of the photosensitive drums 11*a* to 11*d*.

The exposure unit 12, based on image data such as a character, an icon and the like which are input into an image input portion (not shown) from a personal computer and the like, scans each of the photosensitive drums 11*a* to 11*d* for exposure, and is disposed under the developing apparatuses 2*a* to 2*d*. The exposure unit 12 is provided with a laser light source, a polygonal mirror, a reflection mirror and a lens corresponding to each of the photosensitive drums 11*a* to 11*d*. Laser light emitted from the laser light source is directed to the surfaces of the respective photosensitive drums 11*a* to 11*d* from downstream sides in the rotation directions of the photosensitive drums with respect to the chargers 13*a* to 13*d* via the polygonal mirror, the reflection mirror and the lens. By the directed laser light, electrostatic latent images are formed on the surfaces of the respective photosensitive drums 11*a* to 11*d*, and the electrostatic latent images are developed into toner images by the developing apparatuses 2*a* to 2*d*.

An endless intermediate transfer belt 17 is mounted on a tension roller 6, a drive roller 25, and a driven roller 27. The drive roller 25 is driven to rotate by a not-shown motor, the intermediate transfer belt 17 is driven circularly by the rotation of the drive roller 25.

The photosensitive drums 11*a* to 11*d* are disposed to come into contact with the intermediate transfer belt 17 under the intermediate transfer belt 17 along a convey direction (arrow direction in FIG. 1) to be adjacent to one another. Each of primary transfer rollers 26*a* to 26*d* opposes each of the photosensitive drums 11*a* to 11*d* via the intermediate transfer belt 17 and comes into tight contact with the intermediate transfer belt 17 to form a primary transfer portion. At this primary transfer portion, the toner images on the respective photosensitive drums 11*a* to 11*d* are successively transferred onto the intermediate transfer belt 17 at predetermined timing in response to the rotation of the intermediate transfer belt 17. In this way, a full-color toner image with the toner images of cyan, magenta, yellow and black aligned with each other is formed on the surface of the intermediate transfer belt 17.

A secondary transfer roller 34 opposes the drive roller 25 via the intermediate transfer belt 17 and comes into tight contact with the intermediate transfer belt 17 to form a secondary transfer portion. At this second transfer portion, the toner image on the surface of the intermediate transfer belt 17 is transferred onto a paper sheet P. After the transfer, a belt cleaning apparatus 31 sweeps away toners remaining on the intermediate transfer belt 17.

In a lower portion of the image forming apparatus 1, a paper-sheet supply cassette 32 for storing the paper sheets P is disposed, and to the right side of the paper-sheet supply cassette 32, a stack tray 35 for manually supplying paper sheets is disposed. To the left side of the paper-sheet supply cassette 32, a first paper-sheet convey path 33 is disposed to convey the paper sheet P carried from the paper-sheet supply cassette 32 to the secondary transfer portion of the intermediate transfer belt 17. Besides, to the left side of the stack tray 35, a second paper-sheet convey path 36 is disposed to convey a paper sheet carried from the stack tray 35 to the secondary transfer portion. Further, at an upper left portion in the image forming apparatus 1, a fixing portion 18 is disposed to apply a fixing process to the paper sheet P on which the image is formed, and a third paper-sheet convey path 39 is disposed to convey the paper sheet after the fixing process to a paper-sheet ejection portion 37.

The paper-sheet supply cassette 32 is pulled out to outside (front side of the paper surface of FIG. 1) of the image forming apparatus 1 to allow the supply of paper sheets, the paper sheets P stored in the paper-sheet supply cassette 32 are carried one after another to the first paper-sheet convey path 33 by a pick-up roller 33*b* and a separation roller 33*a*.

The first paper-sheet convey path 33 and the second paper-sheet convey path 36 join each other before a pair of resist rollers 33*c*, by the pair of resist rollers 33*c*, the paper sheet P is conveyed to the secondary transfer portion in synchronization with the timing of the image forming operation and the paper-sheet convey operation of the intermediate transfer belt 17. Onto the paper sheet P conveyed to the secondary transfer portion, the full-color toner image on the intermediate transfer belt 17 is secondarily transferred by the secondary transfer roller 34 to which a bias potential is applied, and the paper sheet P is conveyed to the fixing portion 18.

The fixing portion 18 includes a fixing belt that is heated by a heater, a fixing roller that internally comes into contact with the fixing belt, and a pressure roller that tightly pressurizes the fixing roller via the fixing belt and the like. And, the fixing belt and the pressure roller are used to heat and pressurize the paper sheet P on which the toner image is transferred, whereby the fixing process is performed. After the toner image is fixed by the fixing portion 18, the paper sheet P is turned upside down by a fourth paper-sheet convey path 40 if necessary, and the toner image is secondarily transferred onto a back side as well of the paper sheet P by the secondary transfer roller 34 and is fixed by the fixing portion 18. The paper sheet on which the toner image is fixed passes through the third paper-sheet path 39 and is conveyed to the paper-sheet ejection portion 37 by an ejection roller 19*a*.

Figure 2:
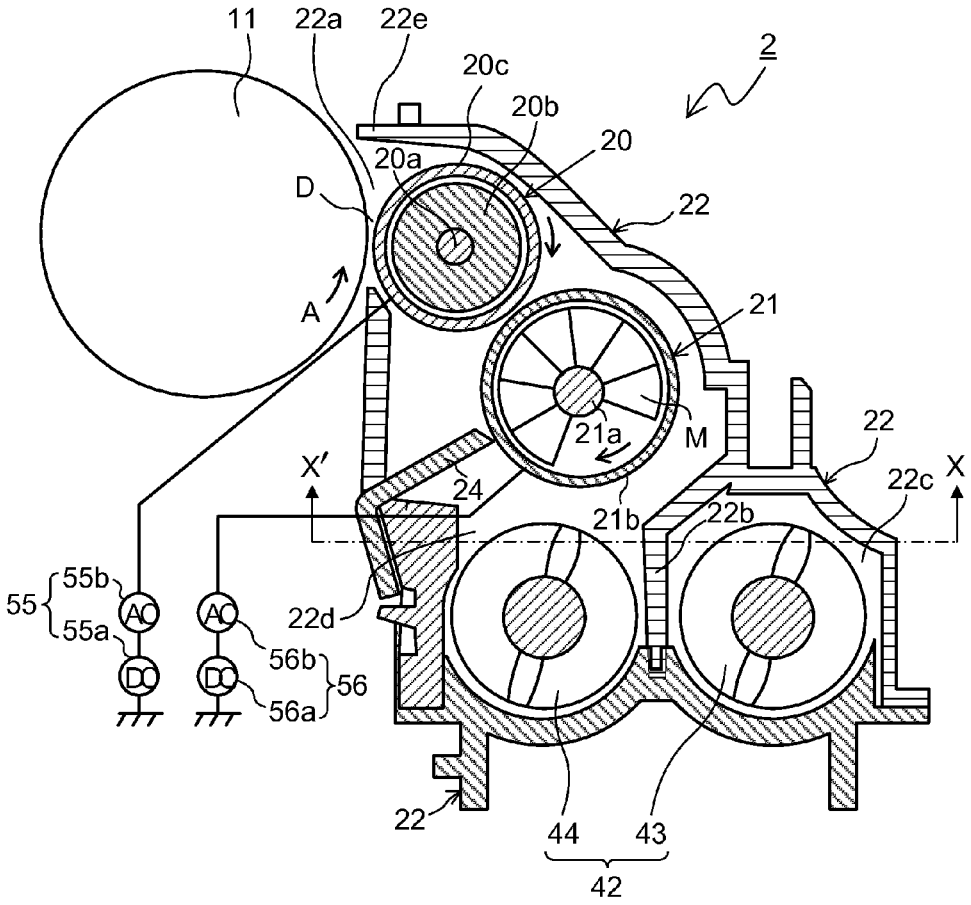
FIG. 2 is a side sectional view of a developing apparatus 2 according to a first embodiment of the present disclosure.

FIG. 2 is a sectional plan view showing a structure of the developing apparatus used in the above image forming apparatus 1. Here, in the following description, a structure and operation of the developing apparatus 2*a* corresponding to the photosensitive drum 11*a* shown in FIG. 1 are described, because structures and operations of the developing apparatuses 2*b* to 2*d* are the same as the developing apparatus 2*a*, description of them is skipped, and the signs a to d for indicating the developing apparatuses and photosensitive drums for the respective colors are omitted.

As shown in FIG. 2, the developing apparatus 2 is composed of a development roller 20, a magnetic roller 21, a regulation blade 24, a stir member 42, a developer container 22 and the like.

The developer container 22 constitutes an outer frame of the developing apparatus 2 and is partitioned into a first convey chamber 22*c* and a second convey chamber 22*d* by a partition portion 22*b* disposed in a lower portion. In the first convey chamber 22*c* and the second convey chamber 22*d*, a developer including carriers and toners are stored. Besides, the developer container 22 rotatably holds the stir member 42, the magnetic roller 21, and the development roller 20. Further, the developer container 22 is provided with an opening 22*a* for exposing the development roller 20 to the photosensitive drum 11.

The development roller 20 opposes the photosensitive drum 11 and is disposed to the right of the photosensitive drum 11 over a predetermined distance. Besides, the development roller 20 forms, at a position that is near and opposes the photosensitive drum 11, a development region D where toners are supplied to the photosensitive drum 11. The magnetic roller 21 faces the development roller 20 over a predetermined distance and is disposed at an obliquely right position below the development roller 20. Besides, the magnetic roller 21 supplies toners to the development roller 20 at a position that is near and opposes the development roller 20. The stir member 42 is disposed substantially under the magnetic roller 21. Besides, the restriction blade 24 is fixed to and held by the developer container 22 at an obliquely left position below the magnetic roller 21.

The stir member 42 is composed of two spirals, that is, a first spiral 43 and a second spiral 44. The second spiral 44 is disposed in the second convey chamber 22*d* under the magnetic roller 21, the first spiral 43 is disposed in the first convey chamber 22*c* to be adjacent to the right of the second spiral 44.

The first and second spirals 43, 44 stir the developer and charge the toners in the developer to a predetermined level. In this way, the toners are held by the carriers. Besides, communication portions (not shown) are formed through both end portions in a longitudinal direction (direction perpendicular of the paper surface of FIG. 2) of the partition portion 22*b* that partitions the first convey chamber 22*c* and the second convey chamber 22*d*. When the first spiral 43 rotates, the charged developer is conveyed from one communication portion formed through the partition portion 22*b* to the second spiral 44, so that the developer circulates in the first convey chamber 22*c* and the second convey chamber 22*d*. And, the developer is supplied from the second spiral 44 to the magnetic roller 21.

The magnetic roller 21 includes a roller shaft 21*a*, a magnetic pole member M, and a non-magnetic sleeve 21*b* that is composed of a non-magnetic material, carries the developer that is stirred by the stir member 42, and supplies only the toners of the carried developer to the development roller 20. In the magnetic pole member M, a plurality of magnets, which are formed into fan shapes in section and have different polarities on the circumferential portions, are alternately disposed and fixed to the roller shaft 21*a* by adhesion and the like. The roller shaft 21*a*, in the non-magnetic sleeve 21*b*, is supported by the development container 22 in a not-to-rotate manner with a predetermined distance formed between the magnetic pole member M and the non-magnetic sleeve 21*b*. The non-magnetic sleeve 21*b* is rotated in the same direction (clockwise direction in FIG. 2) as the development roller 20 by a drive mechanism that is composed of a motor and a gear that are not shown, and a bias 56 with an alternating-current voltage 56*b* superposed on a direct-current voltage 56*a* is applied to the non-magnetic sleeve 21*b*. On a surface of the non-magnetic sleeve 21*b*, the charged developer is formed into a magnetic brush by magnetic force of the magnetic pole member M and carried, the magnetic brush is adjusted to a predetermined height by the regulation blade 24.

When the non-magnetic sleeve 21*b* rotates, the magnetic brush is held and conveyed on the surface of the non-magnetic sleeve 21*b* by the magnetic pole member M, when the magnetic brush comes into contact with the development roller 20, only the toners of the magnetic brush are supplied to the development roller 20 in accordance with the bias 56 applied to the non-magnetic sleeve 21*b*.

The development roller 20 is composed to include a stationary shaft 20*a*, a magnetic pole member 20*b*, a development sleeve 20*c* that is composed of a non-magnetic metal material into a cylindrical shape and the like.

The stationary shaft 20*a* is supported by the developer container 22 in a not-to-rotate manner. On this stationary shaft 20*a*, the development sleeve 20*c* is rotatably held. Further, at a position where the stationary shaft 20*a* opposes the magnetic roller 21, the magnetic pole member 20*b* formed of a magnet is fixed by adhesion and the like over a predetermined distance from the development sleeve 20*c*. The development sleeve 20*c* is rotated in an arrow direction (clockwise direction) in FIG. 2 by a drive mechanism that is composed of a motor and a gear that are not shown. Besides, a development bias 55 with an alternating-current voltage 55*b* superposed on a direct-current voltage 55*a* is applied to the development sleeve 20*c*.

When the development sleeve 20*c*, to which the development bias 55 is applied, rotates in the clockwise direction in FIG. 2, at the development region D, thanks to a potential difference between a development bias potential and an electric potential of an exposure portion of the photosensitive drum 11, the toners carried on the surface of the development sleeve 20*c* fly to the photosensitive drum 11. The flying toners are successively attracted to the exposure portion on the photosensitive drum 11 that rotates in an arrow A direction (counterclockwise direction), and an electrostatic latent image on the photosensitive drum 11 is developed.

Figure 3:
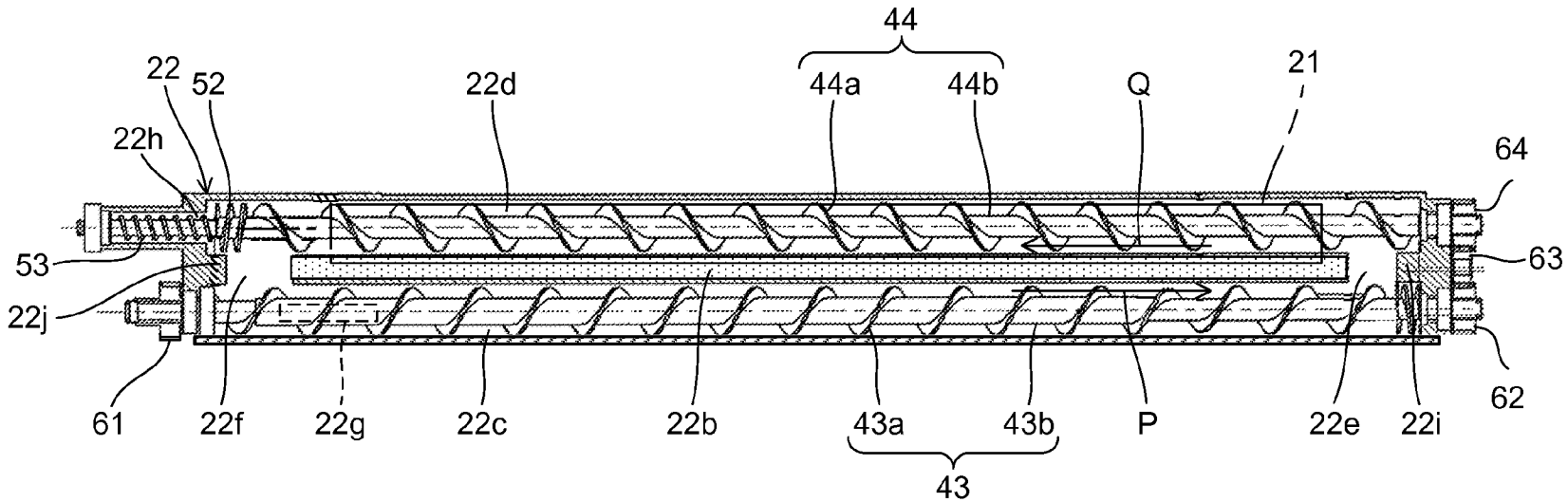
FIG. 3 is a planar sectional view showing a stir portion of the developing apparatus 2 according to the first embodiment.

Next, with reference to FIG. 3, a stir portion of the developing apparatus is described in detail. FIG. 3 is a planar sectional view (sectional view when viewing along a line X-X' in FIG. 2) showing the stir portion.

The developer container 22, as described above, is provided with the first convey chamber 22*c*, the second convey chamber 22*d*, the partition portion 22*b*, an upstream side communication portion 22*e*, and a downstream side communication portion 22*f*, besides, provided with a developer supply opening 22*g*, a developer discharge opening 22*h*, an upstream side wall portion 22*i* and a downstream side wall portion 22*j*. Here, in the first convey chamber 22*c*, the left side of FIG. 2 is defined as an upstream side, the right side of FIG. 2 is defined as a downstream side, besides, in the second convey chamber 22*d*, the right side of FIG. 2 is defined as an upstream side, the left side of FIG. 2 is defined as a downstream side. Accordingly, the communication portion and the side wall portion are called the upstream side and the downstream side respectively with respect to the second convey chamber 22*d*.

The partition portion 22*b* extends in a longitudinal direction of the developer container 22 to partition the developer container 22 such that the first convey chamber 22*c* and the second convey chamber 22*d* are arranged in parallel with each other. The right side end portion of the partition portion 22*b* in the longitudinal direction collaborates with an inner wall portion of the upstream side wall portion 22*i* to form the upstream side communication portion 22*e*, while the left side end portion of the partition portion 22*b* in the longitudinal direction collaborates with an inner wall portion of the downstream side wall portion 22*j* to form the downstream side communication portion 22*f*. And, the developer is able to pass through the first convey chamber 22*c*, the upstream side communication portion 22*e*, the second convey chamber 22*d*, and the downstream side communication portion 22*f* to circulate in the developer container 22.

The developer supply opening 22*g* is an opening via which additional toners and carriers are supplied from a developer supply container (not shown) disposed above the developer container 22 into the developer container 22. The developer supply opening 22*g* is formed through the upstream side (the left side of FIG. 3) of the first convey chamber 22*c*.

The developer discharge opening 22*h* is an opening via which surplus developers in the first and second convey chambers 22*c*, 22*d* in accordance with supplying developers are discharged. The developer discharge opening 22*h* is continuously formed through the downstream side of the second convey chamber 22*d* in a longitudinal direction of the second convey chamber 22*d*.

The first spiral 43 is disposed in the first convey chamber 22*c*, while the second spiral 44 is disposed in the second convey chamber 22*d*.

The first spiral 43 includes a rotational shaft 43*b*, and a first spiral blade 43*a* that is integrally formed with the rotational shaft 43*b* and spirally formed in a shaft direction of the rotational shaft 43*b* at a predetermined pitch. Besides, the first spiral blade 43*a* extends to both end portions in a longitudinal direction of the first convey chamber 22*c*, and is disposed to oppose the upstream side and downstream side communication portions 22*e*, 22*f* as well. The rotational shaft 43*b* is rotatably supported by the upstream side wall portion 22*i* and the downstream side wall portion 22*j* of the developer container 22.

The second spiral 44 includes a rotational shaft 44*b*, and a second spiral blade 44*a* that is integrally formed with the rotational shaft 44*b* and spirally formed of a blade, which faces in a direction opposite to the first spiral blade 43*a*, in a shaft direction of the rotational shaft 44*b* at the same pitch as the pitch of the first spiral blade 43*a*. Besides, the second spiral blade 44*a* has a length longer than a length of the magnetic roller 21 in the longitudinal direction, and further is disposed to extend to a position so as to oppose the upstream side communication portion 22*e*. The rotational shaft 44*b* is disposed in parallel with the rotational shaft 43*b* and rotatably supported by the upstream side wall portion 22*i* and the downstream side wall portion 22*j* of the developer container 22.

Besides, along with the second spiral blade 44*a*, a restriction portion 52 and a discharge blade 53 are integrally formed with the rotational shaft 44*b*.

The restriction portion 52 blocks the developer conveyed to the downstream side in the second convey chamber 22*d* and makes it possible to convey more than a predetermined amount of developer to the developer discharge opening 22*h*. The restriction portion 52 is formed of a blade which is composed of a spiral blade formed on the rotational shaft 44*b* and faces in a direction opposite (opposite phase) to the second spiral blade 44*a*, and has an outer diameter that is substantially the same as an outer diameter of the second spiral blade 44*a*, and is set at a pitch smaller than the pitch of the second spiral blade 44*a*. Besides, the restriction portion 52 forms a predetermined length of gap between an inner wall portion of the downstream side wall portion 22*j* and the like of the developer container 22 and an outer circumference of the restriction portion 52. The surplus developer is discharged from the gap.

The rotational shaft 44*b* extends into the developer discharge opening 22*h*. The rotational shaft 44*b* in the developer discharge opening 22*h* is provided with a discharge blade 53. The discharge blade 53 is formed of a spiral blade that faces in the same direction as the second spiral blade 44*a*, has a pitch smaller than the pitch of the second spiral blade 44*a*, and the blade has an outer diameter smaller than the outer diameter of the second spiral blade 44*a*. Accordingly, when the rotational shaft 44*b* rotates, the discharge blade 53 also rotates, and the developer, which goes over the restriction portion 52 and is conveyed into the developer discharge opening 22*h*, is sent to the left side of FIG. 3 to be discharge to outside of the developer container 22. Here, the discharge blade 53, the restriction portion 52, and the second spiral blade 44*a* are integrally formed with the rotational shaft 44*b* with a synthetic resin.

An outer wall of the developer container 22 is provided with gears 61 to 64. The gears 61, 62 are fixed to the rotational shaft 43*a*, and the gear 64 is fixed to the rotational shaft 44*b*. The gear 63 is rotatably supported by the developer container 22 and meshes with the gears 62, 64.

During a development time an additional developer is not supplied, when the gear 61 is rotated by a drive source such as a motor and the like, the first spiral blade 43*a* rotates together with the rotational shaft 43*b*, the developer in the first convey chamber 22*c* is conveyed by the first spiral blade 43*a* in an arrow P direction, thereafter, conveyed into the second convey chamber 22*d* via the upstream side communication portion 22*e*. Further, when the second spiral blade 44*a* rotates together with the rotational shaft 44*b*, the developer in the second convey chamber 22*d* is conveyed by the second spiral blade 44*a* in an arrow Q direction. Accordingly, the developer is conveyed dramatically changing its height level from the first convey chamber 22*c* through the upstream side communication portion 22*e* into the second convey chamber 22*d*, does not go over the restriction portion 52, and is conveyed to the first convey chamber 22*c* through the downstream side communication portion 22*f*.

As described above, the developer is stirred circulating from the first convey chamber 22*c*, through the upstream side communication portion 22*e*, the second convey chamber 22*d* to the downstream side communication portion 22*f*, and the stirred developer is supplied to the magnetic roller 21.

Next, a case where the developer is supplied from the developer supply opening 22*g* is described. When toners are consumed for development, a developer including carriers is supplied from the developer supply opening 22*g* into the first convey chamber 22*c*.

The supplied developer, like in the development time, is conveyed by the first spiral blade 43*a* in the first convey chamber 22*c* in the arrow P direction, thereafter, conveyed into the second convey chamber 22*d* through the upstream side communication portion 22*e*. Further, the developer in the second convey chamber 22*d* is conveyed by the second spiral blade 44*a* in the arrow Q direction. When the restriction portion 52 rotates thanks to the rotation of the rotational shaft 44*b*, the developer is given a convey force by the restriction portion 52 in a direction opposite to the developer convey direction by the second spiral blade 44*a*. The developer is blocked by the restriction portion 52 and the height level increases, so that a surplus developer goes over the restriction portion 52 and is discharged to outside of the developer container 22 via the developer discharge opening 22*h*.

Figure 4:
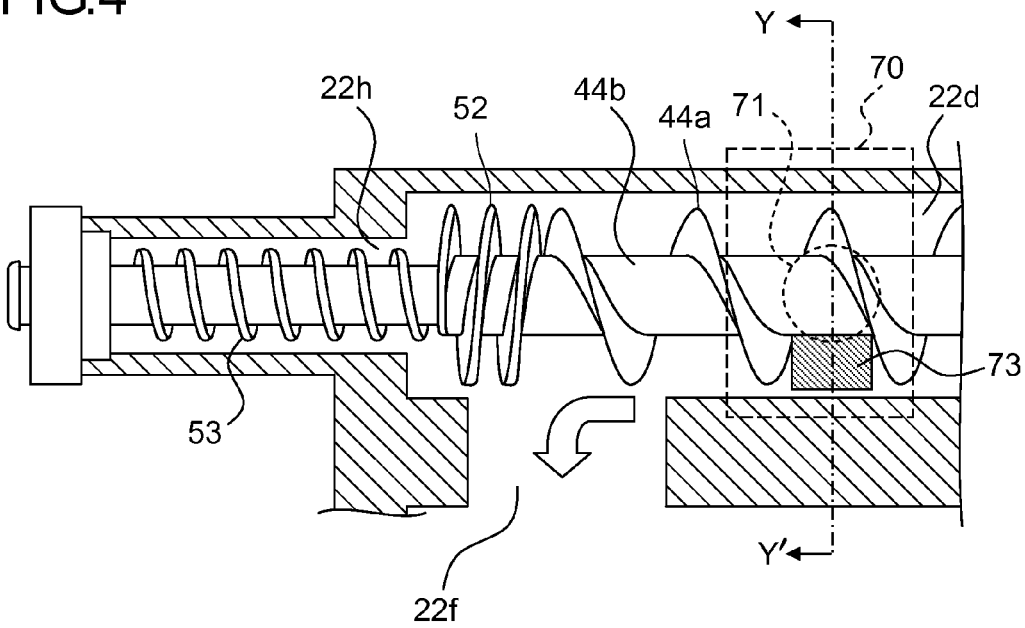
FIG. 4 is an enlarged view of a developer discharge portion and peripheral portions of the developing apparatus 2 according to the first embodiment.

FIG. 4 is an enlarged view of the developer discharge portion and peripheral portions of the developing apparatus according to the first embodiment. In the second convey chamber 22*d*, a sensor disposition portion 70 is disposed at a position very close to the restriction portion 52 in an upstream with respect to the restriction portion 52 in the developer convey direction (white arrow direction in FIG. 4), a toner concentration detection sensor 71 is disposed on a bottom surface of the sensor disposition portion 70. Here, in FIG. 4, the second spiral 44 is situated in front of the toner concentration detection sensor 71, accordingly, the toner concentration detection sensor 71 is shown by a broken line.

As the toner concentration detection sensor 71, a magnetic permeability sensor is used, which detects a magnetic permeability of the developer in the developer container 22. A structure is employed, in which when a magnetic permeability of the developer is detected by the toner concentration detection sensor 71, a voltage value equivalent to the detection result is output to a control portion (not shown), and a toner concentration is decided by the control portion based on an output value from the toner concentration detection sensor 71.

The sensor output value changes in accordance with the toner concentration, the higher the toner concentration becomes, the higher a ratio of the toners to the magnetic carriers becomes, and a percentage of the toners that do not transmit magnetism increases, so that the output value becomes low. On the other hand, the lower the toner concentration becomes, the lower the ratio of the toners to the carriers becomes, and a percentage of the carriers that transmits magnetism increases, so that the output value becomes high.

Besides, the second spiral 44 is provided with a scraper 73 at the portion where the sensor disposition portion 70 is situated. As the scraper 73, for example, a laminated body, which is obtained by laminating a non-woven fabric onto a flexible film that defines a base material, is used and attached, in parallel with the rotational shaft 44*b*, to a scraper support portion 75 (see FIG. 5) that is formed on the rotational shaft 44*b* of the convey spiral 44. The scraper 73 rotates thanks to the rotation of the rotational shaft 44*b*, whereby a detection surface 71*a* (see FIG. 5) of the toner concentration detection sensor 71 is scraped and cleaned, and the developer is prompted to stay in the sensor disposition portion 70.

Figure 5:
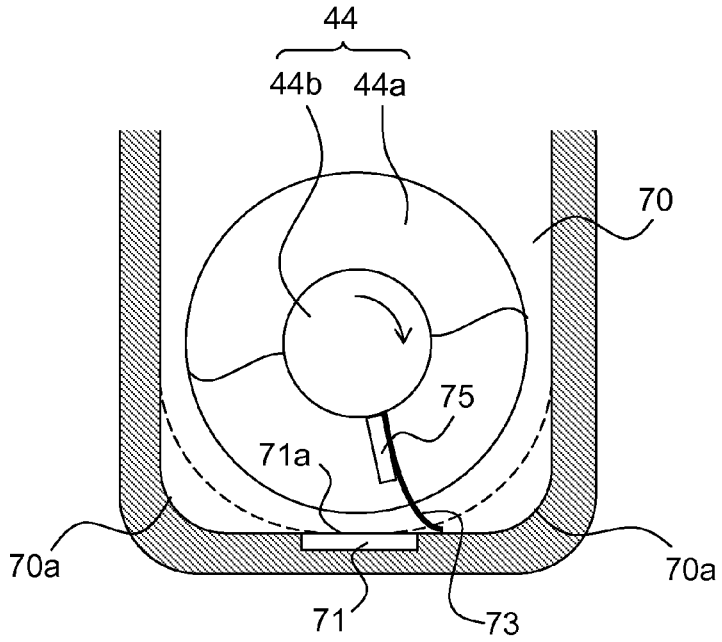
FIG. 5 is a view showing a sectional shape of a sensor disposition portion 70 in FIG. 4.

FIG. 5 is a sectional view (sectional view when viewing along a line Y-Y' in FIG. 4) of the sensor disposition portion 70 in the developing apparatus according to the first embodiment. In the present embodiment, radiuses of curvature of curved surface portions 70*a* on both sides of an inner wall surface of the sensor disposition portion 70 are formed to be smaller than radiuses of curvature of other U-shaped portions (shown by a broken line in FIG. 5) of the second convey chamber 22*d*, whereby a space between the second spiral 44 and the curved surface portion 70*a* of the sensor disposition portion 70 is wider than spaces at the other portions of the second convey chamber 22*d*.

According to this structure, in the sensor disposition portion 70, a sectional area of the second convey chamber 22*d* is larger than sectional areas of the other portions, so that a convey speed of the developer by the second spiral 44 becomes low. As a result of this, the developer stays in the sensor disposition portion 70, and waving (change) of the developer surface that moves to the restriction portion 52 and the downstream side communication portion 22*f* is curbed. Accordingly, it is possible to stabilize the amount of the developer that goes over the restriction portion 52 and is discharged from the developer discharge opening 22*h*, accordingly, even in a case where the process speed of the image forming apparatus 1 is changed, it is possible to maintain the developer amount in the developing apparatus 2 substantially constant.

Besides, the space between the second spiral 44 and a curved surface portion (lower corner portion) 70*a* of the sensor disposition portion 70 is wide, so that the developer is sufficiently present around an outer edge of the detection surface 71*a* of the toner concentration detection sensor 71 that is disposed on the bottom surface of the sensor disposition portion 70. Accordingly, the detection accuracy of the toner concentration detection sensor 71 increases. Further, the bottom surface of the sensor disposition portion 70, which defines a mounting surface for the toner concentration detection sensor 71, becomes flat, so that it also becomes easy to mount the toner concentration detection sensor 71 and the mounting accuracy also increases. In other words, the sensor disposition portion 70 doubles as a deceleration region for curbing the waving (change) of the developer surface and a developer stay portion for increasing the detection accuracy of the toner concentration detection sensor 71, so that compared with a case where the deceleration region and the developer stay region are separately disposed, it becomes easy to adjust the circulation balance of the developer in the developer container 22.

Figure 6:
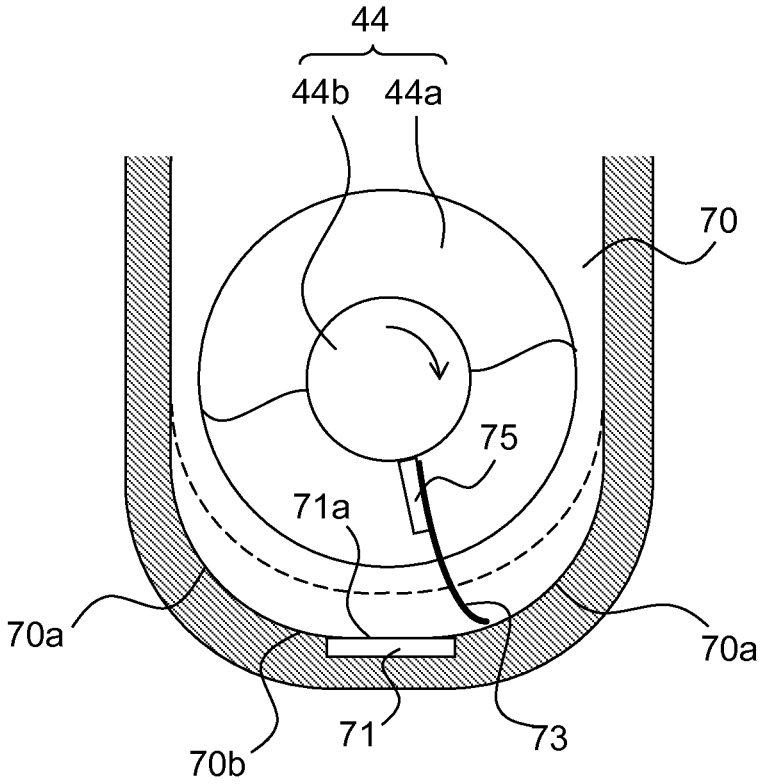
FIG. 6 is a view showing another sectional shape of the sensor disposition portion 70 of the developing apparatus 2 according to the first embodiment.

The sectional shape of the sensor disposition portion 70 is not limited to the shape shown in FIG. 5, for example, as shown in FIG. 6, without changing the radius of curvature of the curved surface portion 70*a* of the sensor disposition portion 70, the distance between the bottom surface 70*b* of the sensor disposition portion 70 and the second spiral 44 may be widened. In this structure as well, by lowering the convey speed of the developer in the sensor disposition portion 70 to curb the waving of the developer surface, it is possible to stabilize the developer amount that is discharged from the developer discharge opening 22*h*.

However, in the case of the sectional shape shown in FIG. 6, compared with FIG. 5, the distance between the second spiral 44 and the bottom surface 70*b* of the sensor disposition portion 70 becomes too wide, whereby there is a risk that the developer flow in the second convey chamber 22*d* becomes slow. Because of this, the sectional shape in FIG. 5 is preferable because it is able to make the developer present sufficiently on the entire detection surface 71*a* of the toner concentration detection sensor 71 while maintaining the developer flow in the second convey chamber 22*d* and also make the mounting surface for the toner residual amount detection sensor 70 flat.

Besides, a dimension of the sensor disposition portion 70 in the developer convey direction is suitably one to two times longer than a diameter of the detection surface 71*a* of the toner concentration detection sensor 71.

Figure 7:
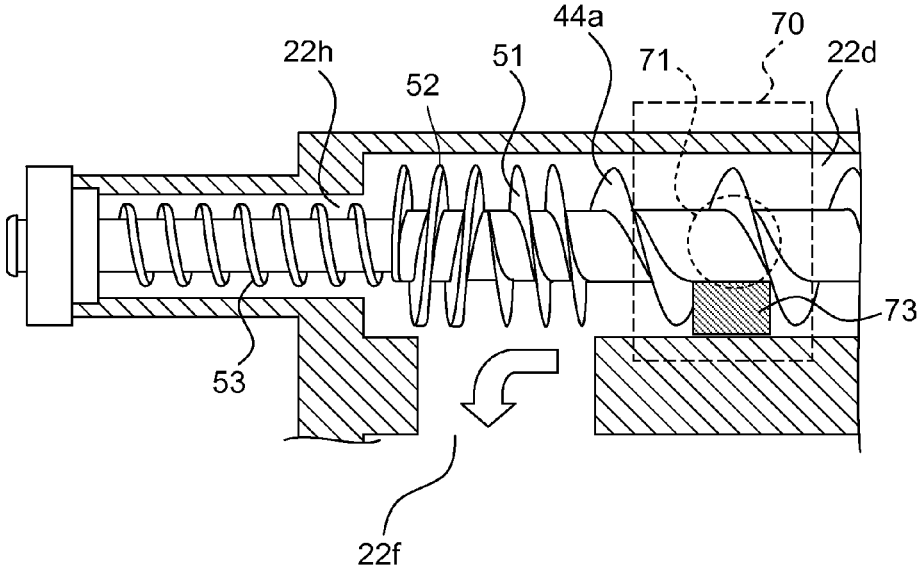
FIG. 7 is a planar sectional view of a developer discharge portion and peripheral portions of the developing apparatus 2 according to a second embodiment of the present disclosure.

FIG. 7 is a sectional side view showing a stir portion of a developing apparatus according to a second embodiment of the present disclosure. In the present embodiment, a deceleration convey portion 51 is disposed on the second spiral 44 to oppose the downstream side communication portion 22*f* at a position very close to the restriction portion 52 in the upstream with respect to the restriction portion 52 in the developer convey direction (white arrow direction in FIG. 4). First, the stir portion, which includes the deceleration convey portion 51 different from the first embodiment, is chiefly described, and description of portions overlapping with the first embodiment is skipped.

The deceleration convey portion 51 is disposed to be adjacent to a position very close to the sensor disposition portion 70 in the downstream with respect to the sensor disposition portion 70 in the developer convey direction, and opposes the downstream side communication portion 22*f*. Besides, the deceleration convey portion 51 is formed of a plurality of blades (here, three) which face in the same direction as the second spiral blade 44*a*. The spiral blade constituting the deceleration convey portion 51 has the same size as the outer diameter of the second spiral blade 44*a*, and is set at a pitch smaller than the pitch of the second spiral blade 44*a*. The blade pitch of the deceleration convey portion 51 is ⅙ to ⅓ of the pitch of the second spiral blade 44*a*, and these spiral blades oppose an opening width in a longitudinal direction of the downstream side communication portion 22*f*.

The deceleration convey portion 51 is disposed to oppose the downstream side communication portion 22*f*, whereby during a time an additional developer is not supplied, the developer blocked by the restriction portion 52 is not conveyed to the developer discharge opening 22*h*, but surely conveyed from the second convey chamber 22*d* to the downstream side communication portion 22*f* thanks to rotation of the deceleration convey portion 51, and further conveyed to the first convey chamber 22*c*. Besides, even if the opening width in the longitudinal direction of the downstream side communication portion 22*f* is narrow, the developer is surely conveyed from the second convey chamber 22*d* to the first convey chamber 22*c*, so that it is possible to shorten a dimension of the developing apparatus 2 in the longitudinal direction. Here, the spiral blade of the deceleration convey portion 51 may not oppose the total opening width of the downstream side communication portion 22*f*, however, in this case, it is desirable that the blade near the restriction portion 52 opposes the opening of the downstream side communication portion 22*f*.

According to this structure, when the rotational shaft 44*b* rotates, the developer is relatively fast conveyed in the second convey chamber 22*d* by the second spiral blade 44*a*, however, the blade pitch of the deceleration convey portion 51 is smaller than the pitch of the second spiral blade 44*a*, accordingly, in the second convey chamber 22*d* where the deceleration convey portion 51 is disposed, the convey speed of the developer becomes lower than the second spiral blade 44*a*. Accordingly, the conveyed developer moves in the convey path waving along a blade outer circumference of the second spiral blade 44*a*, when the pitch of the spiral blade is relatively large, the developer moves fast with the developer height level dramatically changing. On the other hand, like in the deceleration convey portion 51, when the pitch of the spiral blade is relatively small, the change of the developer height level is small, and the developer moves slowly.

Accordingly, during the development time an additional developer is not supplied, when the gear 61 is rotated by the drive source such as the motor and the like, the first spiral blade 43*a* rotates together with the rotational shaft 43*b*, and the developer in the first convey chamber 22*c* is conveyed by the first spiral blade 43*a* in the arrow P direction, thereafter, conveyed into the second convey chamber 22*d* through the upstream side communication portion 22*e*. Further, when the second spiral blade 44*a* rotates together with the rotational shaft 44*b*, the developer in the second convey chamber 22*d* is conveyed by the second spiral blade 44*a* in the arrow Q direction, and conveyed to the sensor disposition portion 70 and the deceleration convey portion 51.

Thanks to the rotations of the first and second spiral blades 43*a* and 44*a*, the developer is conveyed relatively fast with dramatically changing its height level. On the other hand, near the sensor disposition portion 70 and the deceleration convey portion 51, the change of the developer height level is small, and the developer is conveyed relatively slowly, accordingly, even if the developer collides with the restriction portion 52, spattering of the developer is curbed and the developer does not go over an outer circumference of the restriction portion 52. As a result of this, the developer does not go over the restriction portion 52 and is conveyed to the first convey chamber 22*c* through the downstream side communication portion 22*f*.

Next, a case where the developer is supplied from the developer supply opening 22*g* is described. When toners are consumed for development, a developer including carriers is supplied from the developer supply opening 22*g* into the first convey chamber 22*c*.

The supplied developer, like in the development time, is conveyed by the first spiral blade 43*a* in the first convey chamber 22*c* in the arrow P direction, thereafter, conveyed into the second convey chamber 22*d* through the upstream side communication portion 22*e*. Further, the developer in the second convey chamber 22*d* is conveyed by the second spiral blade 44*a* in the arrow Q direction, and conveyed to the sensor disposition portion 70 and the deceleration convey portion 51. When the restriction portion 52 rotates thanks to the rotation of the rotational shaft 44*b*, the developer is given a convey force by the restriction portion 52 in a direction opposite to the developer convey direction due to the second spiral blade 44*a*. The developer, whose convey speed is decelerated by the sensor disposition portion 70 and the deceleration convey portion 51, is blocked near the deceleration convey portion 51 that is situated in an upstream with respect to the restriction portion 52, and the height level increases. As a result of this, a surplus developer (which has the same amount of the developer supplied from the developer supply opening 22*g*) goes over the restriction portion 52 and is discharged to outside of the developer container 22 via the developer discharge opening 22*h*.

Figure 8:
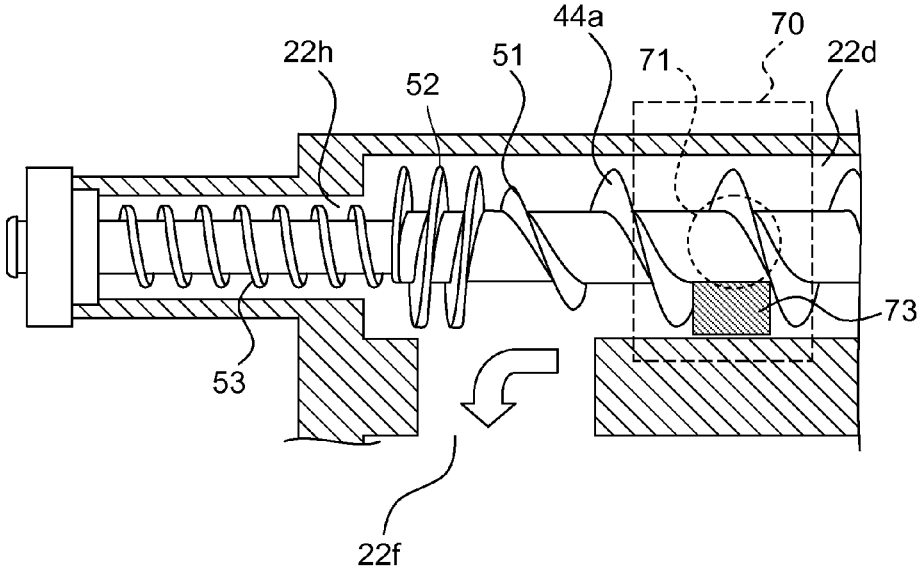
FIG. 8 is a planar sectional view of a developer discharge portion and peripheral portions of the developing apparatus 2 according to a third embodiment of the present disclosure.

FIG. 8 is a sectional side view showing a stir portion of a developing apparatus according to a third embodiment of the present disclosure. The stir portion, which includes a deceleration convey portion different from the second embodiment, is chiefly described, and description of portions overlapping with the second embodiment is skipped.

The first convey chamber 22*c*, the second convey chamber 22*d*, the partition portion 22*b*, the upstream side communication portion 22*e*, the downstream side communication portion 22*f*, the developer supply opening 22*g*, and the developer discharge opening 22*h* of the developer container 22 are disposed and structured in the same way as in the second embodiment. Besides, also the first spiral 43 having the rotational shaft 43*b* and the first spiral blade 43*a* is disposed and structured in the same way as in the second embodiment. Further, the second spiral blade 44*a*, the deceleration convey portion 51, the restriction portion 52, and the discharge blade 53 are integrally disposed on the rotational shaft 44*b* of the second spiral 44, and the second spiral blade 44*a*, the restriction portion 52, and the discharge blade 53 are disposed and structured in the same way as in the second embodiment. On the other hand, the deceleration convey portion 51 is disposed at the same position as in the second embodiment, however, is different from the second embodiment in structure.

The deceleration convey portion 51 is spirally formed of a blade which faces in the same direction as the second spiral blade 44*a*. The spiral blade constituting the deceleration convey portion 51 has a diameter smaller than the outer diameter of the second spiral blade 44*a*, and is set at the same pitch as the pitch of the second spiral blade 44*a*. The deceleration convey portion 51 has one blade, and this blade opposes the downstream side communication portion 22*f*. Besides, the deceleration convey portion 51 may be formed of a plurality of blades, and these blades may oppose the opening width in the longitudinal direction of the downstream side communication portion 22*f*. Further, the spiral blade of the deceleration convey portion 51 may not oppose the total opening width of the downstream side communication portion 22*f*, however, in this case, it is desirable that the blade near the restriction portion 52 opposes the opening of the downstream side communication portion 22*f*.

According to this structure, when the rotational shaft 44*b* rotates, the developer is relatively fast conveyed in the second convey chamber 22*d* by the second spiral blade 44*a*, however, the blade outer diameter of the deceleration convey portion 51 is smaller than the blade outer diameter of the second spiral blade 44*a*, accordingly, in the second convey chamber 22*d* where the deceleration convey portion 51 is disposed, the convey speed of the developer becomes lower than the second spiral blade 44*a*. Accordingly, the conveyed developer moves in the convey path waving along the blade outer circumference of the second spiral blade 44*a*, when the blade outer diameter of the spiral blade is relatively large, the developer moves fast with the developer height level dramatically changing. On the other hand, like in the deceleration convey portion 51, when the blade diameter is relatively small, the change of the developer height level is small, and the developer moves slowly.

Accordingly, like in the second embodiment, near the sensor disposition portion 70 and the deceleration convey portion 51, the change of the developer height level is small, and the developer is conveyed relatively slowly, accordingly, during a development time an additional developer is not supplied, even if the developer collides with the restriction portion 52, spattering of the developer is curbed and the developer does not go over the restriction portion 52, and is conveyed to the first convey chamber 22*c* through the downstream side communication portion 22*f*. On the other hand, in a case where a developer is supplied from the developer supply opening 22*g*, the developer is blocked near the deceleration convey portion 51 that is situated in the upstream with respect to the restriction portion 52, and the height level increases, so that a surplus developer goes over the restriction portion 52 and is discharged to outside of the developer container 22 via the developer discharge opening 22*h*.

According to the above second and third embodiments, the developer conveyed in the second convey chamber 22*d* is first decelerated when passing through the sensor disposition portion 70 and further decelerated when passing through the neighboring deceleration convey portion 51 in the downstream with respect to the sensor disposition portion 70. Accordingly, compared with the first embodiment, it is possible to more effectively curb the waving of the developer surface and surely stabilize the developer amount. Besides, the sensor disposition portion 70 and the deceleration convey portion 51 are disposed to be adjacent to each other, so that the deceleration places for the developer in the second convey chamber 22*d* are put together at one place and it becomes easy to adjust the circulation balance of the developer. Here, the sectional shape of the sensor disposition portion 70 of the developing apparatus 2 according to the second and third embodiments is structured in the same way as in FIG. 5 and FIG. 6 in the first embodiment.

Next, the developer amount in the developer container 22 in a case where the process speed is changed is described. In the image forming apparatus according to the present disclosure, the drive speed of the apparatus is changed in two stages in accordance with a thickness, a kind of the conveyed recording medium, and a kind of the output image. In other words, in a case where the recording medium is a plain paper sheet and a case where a character document is output, the image forming process is performed at a usual drive speed (hereinafter, called a full-speed mode), in a case where the recording medium is a thick paper sheet and a case where a photo image is output, the image forming process is performed at a speed (hereinafter, called a deceleration mode) lower than usual. According to this, in the case where a thick paper sheet is used as the recording medium and the case where a photo image is output, it is possible to secure a sufficient fixing time and increase the image quality.

As described above, when changed from the full-speed mode to the deceleration mode, the rotational speeds of the first spiral 43 and the second spiral 44 also are lowered, so that the developer convey speed in the developer container 22 rapidly changes. As a result of this, the developer in the developer container 22 becomes unbalanced and the developer height level (developer surface) changes, so that the developer amount discharged from the developer discharge opening 22*h* also changes and the developer amount in the developer container 22 changes.

Now, when a stable developer amount in the developer container 22 at the fastest process speed (here, the full-speed mode) is defined as M1 and a stable developer amount in the developer container 22 at the lowest process speed (here, the deceleration mode) is defined as M2, it is preferable that M1 and M2 meet a conditional formula (1).

$$(M2-M1)/M1 \leq 0.11 \quad (1)$$

As describe above, the developer convey speed changes, whereby the developer amount in the developer container 22 also changes, however, by printing an image of a predetermined coverage rate on a predetermined number of paper sheets, the developer amount in the developer container 22 converges on a constant amount, and thereafter, stabilizes. In other words, the stable developer amount M1 in the conditional formula (1) is a developer amount on which the developer amount converges by printing an image of a predetermined coverage rate on a predetermined number of paper sheets at the fastest process speed (full-speed mode). Besides, the stable developer amount M2 is a developer amount on which the developer amount converges by printing an image of a predetermined coverage rate on a predetermined number of paper sheets at the lowest process speed (deceleration mode).

In a case where (M2−M1)/M1 exceeds 0.11, a difference between the developer amounts in the developer container 22 in the full-speed mode and the deceleration mode becomes large, so that the developer amount dramatically increases at a time of changing from the full-speed mode to the deceleration mode. Because of this, even if an additional developer is supplied, it becomes hard for the toner concentration to increase and an image concentration shortage becomes easy to occur. Besides, the amount of the developer also, which goes over the restriction portion 52 and is discharged from the developer discharge opening 22*h*, increases and wasteful consumption of the developer also increases.

Besides, when the developer amount in the developer container 22 changes, the developer height level (developer surface) also changes, however, when the developer amount dramatically decreases at a time of changing from the deceleration mode to the full-speed mode, a disadvantage occurs, in which the developer surface becomes uneven along the outer shape of the second spiral blade 44*a* of the second spiral 44, and an image unevenness occurs.

On the other hand, when the developer surface becomes high and a distance between the developer surface and the magnetic roller 21 nears a value over a predetermined value, the developer scraped from the magnetic roller 21 is not sufficiently mixed with the developer in the second convey chamber 22 and is supplied again to the magnetic roller 20. When (M2−M1)/M1 exceeds 0.11, the change of the developer amount exceeds a margin (tolerance) at the time of changing from the full-speed mode to the deceleration mode, and a development performance is undermined. To surely prevent occurrence of the image unevenness, it is preferable that M1 and M2 meet the following conditional formula (2).

$$(M2-M1)/M1 \leq 0.07 \quad (2)$$

Here, it depends on the specification and process speed of the image forming apparatus 1 including the developing apparatus 2 onto how many paper sheets an image of how high coverage rate is required to be printed before the developer amount converges on M1 (or M2). However, by performing the design such that M1 and M2 meet the conditional formula (1) or (2), it becomes possible to effectively curb the above disadvantages.

As a method for setting M1 and M2 that meet the conditional formula (1) or (2), there is a method for, in accordance with the specification and process speed of the image forming apparatus 1 including the developing apparatus 2, adjusting the outer diameter and pitch of the spiral blade that constitutes the deceleration convey portion 51, the sectional shape (the distance between the second spiral 44 and the bottom surface of the sensor disposition portion 70) of the sensor disposition portion 70, and fluidity of the developer to be used. It is possible to adjust the fluidity of the developer by changing, for example, a mixture ratio of the toners and the carriers of a two-component developer and particle diameters of the toners and the carriers.

The present disclosure is not limited to the above embodiments, and various modifications are possible without departing from the scope and spirit of the present disclosure. For example, the present disclosure is not limited to the developing apparatus that includes the magnetic roller 21 and the development roller 20 that are shown in FIG. 2, and applicable to various developing apparatuses that use a two-component developer including toners and carriers. For example, in each of the above embodiments, the two shaft convey type of developing apparatus is described, which includes the first convey chamber 22*c* and the second convey chamber 22*d* disposed in parallel with each other as the developer circulation paths in the developer container 22, however, the present disclosure is also applicable to a three shaft convey type of developing apparatus which includes a collection convey chamber that collects the developer scraped from the magnetic roller 21 and makes the collected developer join the developer in the second convey chamber 22*d*.

Besides, in each of the above embodiments, the example is described, in which the deceleration convey portion 51 is composed of the spiral blade that is formed at the pitch smaller than the pitch of the second spiral blade 44*a* of the second spiral 44 or the spiral blade that is formed with the outer diameter smaller than the outer diameter of the second spiral blade 44*a*, however, the present disclosure is not limited to this, and the deceleration convey portion 51 may be composed of a spiral blade that is provided with a plurality of holes and the developer convey speed may be lowered. In this case as well, the same effect as the above effect is obtained.

Besides, the present disclosure is not limited to the tandem type of color printer, and is applicable to various image forming apparatuses that use a two-component development system such as a digital or analog monochrome copy machine, a monochrome printer, a color copy machine, a facsimile and the like. Hereinafter, effects of the present disclosure are further described specifically based on examples.

Examples

In the image forming apparatus shown in FIG. 1, an investigation has been performed into the change of the developer amount, the image concentration and the occurrence of an image unevenness in the case of changing from the full-speed mode to the deceleration mode. Here, tests are made for the cyan image forming portion Pd that includes the photosensitive drum 11*d* and the developing apparatus 2*d* with the system speed (photosensitive drum circumferential speed) set at 330 mm/sec during a time of the full-speed mode, and the system speed set at 165 mm/sec (½ of the full-speed mode) during a time of the deceleration mode.

In a test method, a structure is defined as a present disclosure 1 which incorporates the developing apparatus 2 according to the second embodiment, in which the sensor disposition portion 70 is formed to be the sectional shape as shown in FIG. 5, and the deceleration convey portion 51 having the spiral blade of the small pitch as shown in FIG. 7 is incorporated, a structure is defined as a present disclosure 2 which incorporates the developing apparatus 2 according to the third embodiment, in which the sensor disposition portion 70 is formed to be the sectional shape as shown in FIG. 5, and the deceleration convey portion 51 having the spiral blade of the small outer diameter as shown in FIG. 8 is incorporated, and structures are defined as present disclosures 3 and 4, in which the sensor disposition portion 70 is formed to be the sectional shape as shown in FIG. 5, and which incorporates the developing apparatus 2 according to the first embodiment in which the deceleration convey portion 51 is not disposed as shown in FIG. 4.

Besides, a structure is defined as a comparison example 1 which incorporates the developing apparatus 2, in which the sectional shape of the sensor disposition portion 70 is formed to be the U shape that is the same as the other portions of the second convey chamber 22*d*, and the deceleration convey portion 51 having the spiral blade of the small pitch as shown in FIG. 7 is incorporated, and a structure is defined as a comparison example 2, in which the sectional shape of the sensor disposition portion 70 is formed to be the U shape that is the same as the other portions of the second convey chamber 22*d* and which incorporates the developing apparatus 2 in which the deceleration convey portion 51 is not disposed.

The development roller 20 used in the present disclosures 1 to 4 and the comparison examples 1 and 2 is 16 mm in outer diameter, and 700 rpm in revolution number, and the magnetic roller 21 is 20 mm in outer diameter, and 878 rpm in revolution number. In the first spiral 43, the first spiral blade 43*a* is 18 mm in outer diameter, and is 30 mm (the number of loops is 2) in blade pitch, further, the rotational shaft 43*b* is 7 mm in shaft diameter, and 500 rpm in revolution number. On the other hand, the second spiral blade 44*a* of the second spiral 44 is 18 mm in outer diameter, and is 30 mm (the number of loops is 2) in blade pitch, further, the rotational shaft 44*b* is 7 mm in shaft diameter, rotates in the direction opposite to the first spiral blade 43*a*, is 500 rpm in revolution number. The downstream side communication portion 22*f* of the developer container 22 is 30 mm in opening width.

In the sensor disposition portion 70 in the present disclosures 1 to 3, the distance between the second spiral 44 and the curved surface portion 70*a* of the sensor disposition portion 70 is set at 3 mm in maximum distance, and the distance between the second spiral 44 and the bottom surface 70*b* of the sensor disposition portion 70 is set at 1.5 mm. Besides, in the sensor disposition portion 70 in the present disclosure 4, the distance between the second spiral 44 and the curved surface portion 70*a* of the sensor disposition portion 70 is set at 2 mm in maximum distance, and the distance between the second spiral 44 and the bottom surface 70*b* of the sensor disposition portion 70 is set at 1.5 mm. And, the distance between the portion other than the sensor disposition portion 70 of the second spiral 44 and the inner wall surface lower portion of the second convey chamber 22*d* is set at 1.5 mm. On the other hand, in the comparison examples 1 and 2, the distances between the second spiral 44 and the curved surface portion 70*a* and the bottom surface 70*b* of the sensor disposition portion 70 are both set at 1.5 mm.

The deceleration convey portion 51 in the present disclosure 1 and the comparison example 1 is composed of three spiral blades which are each 18 mm in outer diameter and 5 mm in pitch. Besides, the deceleration convey portion 51 in the present disclosure 2 is composed of one spiral blade which is 12 mm in outer diameter and 30 mm in pitch.

An average particle diameter of the toners in the developing apparatus 22 is 6.8 μm, and an average particle diameter of the carriers is 35 μm, a weight ratio of the toners to the carriers is 9%. A weight ratio of the carriers to additional toners supplied into the developing apparatus 22 is 10%. 400 g of the developer are stored in the developer container 22 (the first and second convey chambers 22*c*, 22*d*), this amount is a predetermined amount that does not include a surplus developer in the developer container 22.

In measurement of the developer amount, respective test machines are used, and an image of a coverage rate of 5% is successively printed on 1,000 paper sheets in the deceleration mode, thereafter, the developing apparatus 2 is demounted, and a weight of the developing apparatus 2 is measured. Next, the developing apparatus 2 is disposed again in the image forming apparatus 1, an image of a coverage rate of 5% is successively printed on 1,000 paper sheets in the full-speed mode, thereafter, the developing apparatus 2 is demounted, and a weight of the developing apparatus 2 is measured. A weight of the empty developing apparatus 2 with the developer removed is subtracted from the measured weight of the developing apparatus 2, whereby the stable developer amounts M1 and M2 are calculated. Further, from the calculated values of M1 and M2, the change rate (M2−M1)/M1 of the developer amount is calculated.

In evaluation of the image concentration, immediately after the changing from the deceleration mode to the full-speed mode, a solid image is printed on an entire surface of an A3 size paper sheet, reflection concentrations at left, center, and right positions of a front end portion and a back end portion of the image, that is, 6 points in total are measured by a reflection densitometer (the Macbeth RD912), when the reflection concentrations (ID image density) at the 6 points each exceed 1.20 and the reflection concentrations at the 6 points are within 0.20 in unevenness, it is evaluated "good" (○), when the reflection concentrations at the 6 points each exceed 1.20 but the reflection concentrations at the 6 points exceed 0.20 in unevenness, it is evaluated "fair" (Δ), and in any other cases, it is evaluated "poor" (×). In evaluation of the image unevenness, in the deceleration mode and the full-speed mode, a solid image is printed on an entire surface of an A3 size paper sheet, and visually observed, when an image unevenness is unrecognizable, it is evaluated "good" (○), when an image unevenness is recognizable but is not problematic in practical use, it is evaluated "fair" (Δ), and when an image unevenness is recognizable and somewhat problematic in practical use, it is evaluated "poor" (×). Besides, immediately after the changing from the deceleration mode to the full-speed mode, when the change of the developer discharge amount is small, it is evaluated "good" (○), when the change of the developer discharge amount is somewhat large, it is evaluated "fair" (Δ), and when the change of the developer discharge amount is large, it is evaluated "poor" (×). The results are shown in a table 1.

TABLE 1

| | developer weight [g] | | | image | image | change of developer discharge |
|---|---|---|---|---|---|---|
| | M1 | M2 | (M2 − M1)/M1 | concentration | unevenness | amount |
| present disclosure 1 | 300 | 313 | 0.04 | ○ | ○ | ○ |
| present disclosure 2 | 298 | 318 | 0.07 | ○ | ○ | ○ |
| present disclosure 3 | 290 | 318 | 0.10 | ○ | Δ | Δ |
| present disclosure 4 | 288 | 320 | 0.11 | ○ | Δ | Δ |
| comparison example 1 | 285 | 320 | 0.12 | Δ | Δ | x |
| comparison example 2 | 260 | 300 | 0.15 | x | x | x |

As apparent from the table 1, in the present disclosures 1 and 2 in which the deceleration convey portion 51 is disposed in the second convey chamber 22*d*, (M2−M1)/M1≤0.07, and the changes of the stable developer amounts M1 and M2 at the time of the changing from the deceleration mode to the full-speed mode are curbed. Besides, the image concentration unevenness and the image unevenness are unrecognizable. It is conceivable that in the present disclosures 1 and 2, the change of the developer discharge amount is curbed small and a stable development performance is obtained. Besides, in the present disclosures 3 and 4 in which the deceleration convey portion 51 is not disposed in the second convey chamber 22*d*, (M2−M1)/M1≤0.11, a drop of the image concentration is unrecognizable, but an image unevenness is recognizable in the range where there is not a problem in practical use, and the change of the developer discharge amount is somewhat large. It is conceivable that in the present disclosures 3 and 4, the sectional area of the sensor disposition position 70 is large, accordingly, the effect is somewhat inferior to the present disclosures 1 and 2, but the changes of the stable developer amounts M1 and M2 at the time of the changing from the deceleration mode to the full-speed mode are curbed.

In contrast, in the comparison example 1 in which the deceleration convey portion 51 is disposed but the sectional area of the sensor disposition position 70 is not large, (M2−M1)/M1=0.12 (>0.11), and the changes of the stable developer amounts M1 and M2 at the time of the changing from the deceleration mode to the full-speed mode are large. As a result of this, an unevenness exceeding 0.20 occurs in the reflection concentrations at the front end portion and the back end portion of the image, and an image unevenness is recognizable although it is in the range where there is not a problem in practical use. Besides, in the comparison example 2 in which the deceleration convey portion 51 is not disposed and the sectional area of the sensor disposition position 70 is not large, (M2−M1)/M1=0.15 (>0.11), the change of the developer discharge amount also becomes large, and a large amount of developer is discharged at the time of the changing to the full-speed mode, so that the image concentration unevenness and the occurrence of image unevenness are in a level that is problematic in practical use.

From the above results, in the developing apparatus in the present disclosure in which M1 and M2 meet (M2−M1)/M1≤0.11, it is confirmed that the change of the developer amount at the time of the changing of the process speed is curbed, accordingly, it is possible to effectively curb occurrence of a defective image and discharge of a wasteful developer. Especially, in a case where (M2−M1)/M1≤0.07 is met, it is confirmed that the image concentration unevenness, the occurrence of the image unevenness, and the change of the developer discharge amount are more effectively curbed.

The present disclosure is applicable to a developing apparatus that is used for image forming apparatuses such as a copy machine, a printer, a facsimile, a multi-function machine of them and the like that use an electro-photographic system, and an image forming apparatus that includes the developing apparatus, more particularly, to a developing apparatus that performs supply of a two-component developer including toners and carriers, and discharges a surplus developer and to an image forming apparatus that includes the developing apparatus.

What is claimed is:

1. A developing apparatus comprising:

a developer container that is partitioned into a plurality of convey chambers which include a first convey chamber and a second convey chamber having a U shape in section which are disposed in parallel with each other, and that stores a two-component developer which includes a carrier and a toner;

a first stir member that stirs and conveys the developer in the first convey chamber in a rotational axis direction;

a second stir member that is composed of a rotational shaft and a spiral blade formed on an outer circumference of the rotational shaft, stirs and conveys the developer in the second convey chamber in a direction opposite to the first stir member;

a developer carry body that is rotatably supported in the developer container and carries on a surface thereof the developer in the second convey chamber;

a communication portion that connects the first convey chamber and the second convey chamber to each other at both end portions in a longitudinal direction thereof;

a developer supply opening that is arranged to supply the developer into the developer container;

a developer discharge opening which is formed at an end portion in a downstream side of the second convey chamber and from which a surplus developer is discharged;

a restriction portion that is disposed in a downstream of the communication portion with respect to the second stir member to oppose the developer discharge opening in a developer convey direction, and places a restriction on movement of the developer to the developer discharge opening;

a sensor disposition portion that is a portion which is formed in an upstream of the second convey chamber with respect to the restriction portion in the developer convey direction, and where a toner concentration sensor for detecting a toner concentration in the developer is disposed, wherein across a predetermined width in the developer convey direction including a detection surface of the toner concentration sensor, a distance between curved surface portions on both sides of a U-shaped inner wall surface and the second stir member is wider than another portion of the second stir chamber, wherein in the sensor disposition position, a distance between a bottom surface and the second stir member is equal to a distance at another portion of the second convey chamber, and a radius of curvature of the curved surface portion is smaller than a radius of curvature of another portion of the second convey chamber.

2. The developing apparatus according to claim 1, wherein the second convey chamber is provided with a deceleration convey portion, which partially lowers a convey speed of the developer in the second convey chamber, at a very nearby position in a downstream with respect to the sensor disposition position.

3. The developing apparatus according to claim 2, wherein the deceleration convey portion is composed of a spiral blade that is formed at a pitch smaller than a pitch of the spiral blade of the second stir member.

4. The developing apparatus according to claim 2, wherein the deceleration convey portion is composed of a spiral blade that is formed with an outer diameter smaller than an outer diameter of the spiral blade of the second stir member.

5. The developing apparatus according to claim 1, wherein the restriction portion is composed of a spiral blade with a phase opposite to a phase of the spiral blade of the second stir member.

6. The developing apparatus according to claim 2, wherein the deceleration convey portion is disposed to oppose the communication portion.

7. A developing apparatus comprising:

a developer container that is partitioned into a plurality of convey chambers which include a first convey chamber and a second convey chamber having a U shape in section which are disposed in parallel with each other, and that stores a two-component developer which includes a carrier and a toner a first stir member that stirs and conveys the developer in the first convey chamber in a rotational axis direction;

a second stir member that is composed of a rotational shaft and a spiral blade formed on an outer circumference of the rotational shaft, stirs and conveys the developer in the second convey chamber in a direction opposite to the first stir member;

a developer carry body that is rotatably supported in the developer container and carries on a surface thereof the developer in the second convey chamber;

a communication portion that connects the first convey chamber and the second convey chamber to each other at both end portions in a longitudinal direction thereof;

a developer supply opening that is arranged to supply the developer into the developer container;

a developer discharge opening which is formed at an end portion in a downstream side of the second convey chamber and from which a surplus developer is discharged;

wherein the first stir member and the second stir member are changeable in rotational speed into a plurality of steps, and when a stable developer amount in the developer container when the first stir member and the second stir member are rotated at a fastest speed is M1, and a stable developer amount in the developer container when the first stir member and the second stir member are rotated at a lowest speed is M2, (M2−M1)/M1≤0.11 is met.

8. The developing apparatus according to claim 7, wherein M1 and M2 meet $(M2-M1)/M1 \leq 0.07$.

9. An image forming apparatus in which the developing apparatus according to claim 1 is incorporated.

10. An image forming apparatus which incorporates a developing apparatus according to claim 7.

* * * * *